US008831270B1

(12) United States Patent
Dimitrov

(10) Patent No.: US 8,831,270 B1
(45) Date of Patent: Sep. 9, 2014

(54) SINGLE MAGNET COAXIAL LOUDSPEAKER

(71) Applicant: Dimitar Kirilov Dimitrov, Sofia (BG)

(72) Inventor: Dimitar Kirilov Dimitrov, Sofia (BG)

( * ) Notice: Subject to any disclaimer, the term of this patent is extended or adjusted under 35 U.S.C. 154(b) by 0 days.

(21) Appl. No.: 13/962,118

(22) Filed: Aug. 8, 2013

(51) Int. Cl.
*H04R 25/00* (2006.01)

(52) U.S. Cl.
USPC ..... 381/401; 381/414; 381/182

(58) Field of Classification Search
USPC ..... 381/182, 401–402, 412, 414
See application file for complete search history.

(56) References Cited

U.S. PATENT DOCUMENTS 2,539,672 A 1/1951 Olson et al.
2,638,510 A 5/1953 Brami
4,164,631 A * 8/1979 Garner et al. ..... 381/401
4,256,930 A 3/1981 Garner et al.
5,740,265 A * 4/1998 Shirakawa ..... 381/401
6,778,677 B2 * 8/2004 Coffin ..... 381/401
7,519,191 B2 * 4/2009 Enomoto et al. ..... 381/401

OTHER PUBLICATIONS

U.S. Appl. No. 90/003,632, filed Jan. 1, 2009, Chun-Yi Lin et al.

* cited by examiner

*Primary Examiner* — Suhan Ni

(57) ABSTRACT

Single magnet coaxial loudspeaker having two air gaps on both sides of its faces, front gap of larger diameter for low frequency voice-coil and the opposite gap accommodating compression driver voice-coil. Front voice-coil drives low frequency membrane and rear voice-coil drives high frequency diaphragm, radiating sound waves through a phasing plug to the horn input through an opening into the magnetic structure, whereas the membrane acts as horn flair. Common region geometry around bottom pole of the magnetic structure controls flux line proportions between the two gaps. The five embodiments use series or parallel, inner or outer magnetomotive flux division. These are suitable for much simpler, more reliable and better balanced coaxial loudspeakers for professional and high-end markets.

7 Claims, 9 Drawing Sheets

SINGLE MAGNET COAXIAL LOUDSPEAKER

CROSS-REFERENCE TO RELATED APPLICATIONS

This application, for not critical part of it, uses the frammis vane disclosed in an applicant's paper "Single Permanent Magnet Co-Axial Loudspeakers", presented at the 134 AES Convention in Rome, Italy 4-7 May 2013, which is incorporated by reference.

BACKGROUND

Most of the single magnetic structure coaxial loudspeakers currently used for Public Address systems are known as comprising a low frequency cone type loudspeaker and a high frequency compression driver loaded by a horn radiating through an opening into the magnetic structure axis. Most of these coaxial loudspeakers are successors of a prior art patent illustrated in FIG. 1, named "LOUDSPEAKER HAVING IMPROVED MAGNETIC ASSEMBLY" [U.S. Pat. Des. 4,256,930/Mar. 17, 1981]. This magnetic assembly is series flux division type, using two outer gaps on both faces of an annular magnet, which gaps use substantially the same flux lines serially closing the available magnet flux lines through both gaps. A much earlier patent [U.S. Pat. Des. 2,539,672/Jan. 30, 1951] invented by Harry Olson et al., demonstrates a "COAXIAL DUAL-UNIT ELECTRODYNAMIC LOUDSPEAKER" using serially connected gaps in respect to the flux lines closing through them. This seems to be the earliest single magnet coaxial loudspeaker with serially connected gaps, even though this is not a typical horn loaded coaxial loudspeaker and is not radiating high frequency band through the magnetic structure axis. The Tannoy patent "LOUDSPEAKER HAVING IMPROVED MAGNETIC ASSEMBLY", illustrated as Prior Art in FIG. 1, uses and claims a non-magnetic spacing ring 22, and a central pole piece encircling flange 18 proximate to the rear annular plate, by way of the non-magnetic spacing ring to constitute the sole fixing for the pole piece. In accordance with the patent, as a result of the shunting effect of the magnetic path passing through the flange on the central pole piece and then through the non-magnetic spacing member to the rear annular plate, the required degree of shunting is obtained by selecting the proportions of the cross sections of the flange and of the non-magnetic spacing member, so as to give the magnetic path a reluctance of the required magnitude. As a practical result, an increase of 20% of the low frequency gap flux is obtained by the old and famous "Dual Concentric" loudspeaker covered by this prior art application, which is still in production by the Tannoy Company. At the time of this patent application issuing during the last century 70s, this 20% increase of the low frequency gap flux was referred to and marketed as "Revolutionary Flux Increase".

Coaxial single magnet loudspeakers of parallel flux divisions are known to exist in prior art as early as May 12, 1953 in the patent—"DUPLEX LOUD-SPEAKER" patented by Joseph Brami [U.S. Pat. No. 2,638,510]. This patent offers a magnet having outer and inner gaps and a low frequency coil in said outer gap. Much later, 46 years after, on Jan. 1, 2009, substantially identical magnetic structure of parallel flux division type is patented by Chun-Yi Lin in the patent "SINGLE MAGNET COAXIAL LOUDSPEAKER" [US Patent 2009/0003632 A1]. Both inventions do not offer any way to control flux proportions between low frequency and high frequency gaps, nor seek any such optimal flux proportion ratios. They both suffer from the lack of a way to reduce the interference between the alternative magnetic field of the low frequency voice-coil current and the high frequency voice-coil gap permanent field. In the high powered single magnet coaxial loudspeakers, the low frequency voice-coil current may reach tens of amperes, leading to substantially pronounced cross modulation interferences through the common magnetic structure, with the high frequency voice-coil usually being much more sensitive to such interferences.

Most of the available prior art single magnet coaxial loudspeakers of the serially flux division type could be characterized by having similar flux line numbers for both gaps. This type of coaxial loudspeakers, together with the available parallel flux division single magnet coaxial loudspeakers, do not offer any way to control flux line proportion between the two gaps, do not seek substantially higher low frequency gap flux availability, nor do they offer any way to reduce cross modulation interferences between the two magnetic paths.

The current invention offers a novelty hardware solution for building single permanent magnetic structures for coaxial loudspeakers, using a completely new approach of specifying a common region of soft magnetic material in the bottom pole piece, or at the bottom pole piece/yoke connection near and parallel to the high frequency voice-coil gap, and changing the position and the geometry of this common region in order to control the flux division in such a way as to insure more than three times higher flux availability for the low frequency voice-coil gap, which is of a larger diameter than the high frequency voice-coil gap. Such a single magnet circuit design hardware solution, insuring about three times as much or higher and controllable flux for the low frequency voice-coil, by series, parallel or mixed flux division, is the subject of this invention.

Other advantages of one or more aspects are that the total reluctance of the magnetic structure has largely been reduced by the common region of soft magnetic material parallel to the high frequency gap, in comparison with prior art illustration from FIG. 1, where this parallel to the high frequency gap region 22 is of non-magnetic material, and that the cross flux modulation of the permanent high frequency gap flux by the low frequency voice-coil current induced alternative flux, has been substantially reduced due to this common parallel soft magnetic region.

Another advantage of one or more aspects is that the thermal stability of the offered embodiments of series flux division types is greatly improved due to the elimination of this very critical non-magnetic component 22 in FIG. 1, having different thermal expansion coefficient than the soft magnetic material neighboring parts.

DESCRIPTION OF THE INVENTION

Provided is a single magnet coaxial loudspeaker having a common magnetic structure with two opposing voice-coil gaps with different diameters on both sides of its annular permanent magnet faces. The larger diameter front positioned gap accommodates a low frequency cone membrane voice-coil, while the smaller diameter opposite positioned gap accommodates a compression driver diaphragm voice-coil creating sound waves in front of an acoustic transformer commonly referred to as a phasing plug. This phasing plug connects the compression chamber to the horn throat through an opening into the magnetic structure axis. The horn throat area extension has substantially the same expansion rate from the phasing plug input, all the way through to the cone membrane apex neck area, after which the horn expansion follows either the membrane expansion or the expansion of a nested external horn, properly attached in front of the low frequency membrane.

The magnetic structure with its top pole piece defines the one side of the larger diameter gap, the other side being defined by a soft magnetic material yoke of predetermined thickness, which yoke is permanently fixed to part of the bottom pole piece in such a way as to define one side of a common region whose geometry controls the flux division to insure a substantial flux to be directly headed towards the low frequency voice-coil gap and only about one third or less of this low frequency flux to be available for the high frequency gap alone.

It is an object of the invention to utilize all the available magnetic flux lines from a single annular permanent magnet in different proportions between the two gaps, insuring about three times as much flux lines or more for the larger diameter low frequency voice-coil gap. This approach makes much better balance between magnetic energy distribution for a much more efficient (30% or so) horn loaded compression driver, and for a low frequency direct radiating driver, only having a few percent maximum efficiency, and needing much more magnetic energy to ensure reasonable sensitivities. This approach, to our knowledge, is not sought for in prior art, where most of the available single magnet coaxial loudspeakers use more or less the same flux through both gaps.

It is another object of the invention to offer different embodiments distinguishable by the way the two gaps are positioned in respect to the two annular magnet diameters, i.e. whether the magnet is outer or inner to the respective gap. Three main types are practical and easily distinguishable: using outer magnet for both gaps; using inner magnet for both gaps; or placing the low frequency gap at the outer magnet diameter and the high frequency voice-coil gap at the inner diameter of the annular magnet. The first two mentioned embodiments might be considered as series type flux division structures, while the third might be considered as a parallel type flux division structure. Series or parallel flux division structures are recognizable by the way the total magnetomotive force distributes flux lines between the two gaps. Using an outer magnet for both gaps makes better utilization of ferrite magnets, while using an inner magnet for both gaps is currently more practical for Neodymium magnet usage. Neodymium magnets are very convenient for parallel magnetic flux division structures using outer voice-coil gap for the low frequency cone membrane and inner voice-coil gap for the compression driver diaphragm voice-coil. Not to limit the invention just to parallel or to series flux division, a fourth embodiment is presented using outer voice-coil gap for low frequency cone membrane and parallel to it two inner voice-coil gaps on both inner magnet faces. These two inner gaps are connected in series with one another using the same flux through both of them, and are conveniently used by a dual diaphragm compression driver utilizing a common differential phasing plug. This fourth embodiment is actually a dual band coaxial loudspeaker, using dual compression driver comprising two diaphragms/voice-coil assemblies for high frequency, driven by the same signal for doubling the acoustic power. The next embodiment, hopefully not the last one, uses substantially the same physical structure as the previous embodiment, but differs in the way it uses the two high frequency compression drivers diaphragms/voice-coil assemblies—this time they are used at different frequency bands, i.e. one of the diaphragms is used at mid frequencies, while the other is used at high frequencies, thus actually making up three-axial three band coaxial loudspeaker.

BRIEF DESCRIPTION OF THE DRAWINGS

The invention will be better understood and other advantages of the invention will become more clearly apparent in the light of the following description and with reference to the appended drawings, in which.

DRAWING NUMERALS

10—Permanent magnet
11*a*—Internal yoke to bottom pole piece common region, connecting parts 14*a* and 16*a*
11*b*—External yoke to bottom pole piece common region, connecting parts 14*b* and 17*b*
11*c*, 11*d*—Bottom pole piece common transition region, whose position defines the parallel flux division proportions between the two gaps fluxes
12*a*, 12*b*, 12*c*, 12*d*—Top pole pieces
13—High frequency voice-coil gap
13*a*—Rear high frequency voice-coil gap
13*b*—Front high frequency voice-coil gap
14*a*, 14*b*, 14*c*, 14*d*—Bottom pole piece
15—Low frequency voice-coil gap
16*a*, 16*c*—Internal yoke
17*b*, 17*c*, 17*d*—External yoke
18—Dual gap core
19—Dual gap core mounting flange
20—High frequency voice-coil
22—High frequency diaphragm

22*a*, 22*b*—Suspension members
23—Supporting rings, comprising parts 23*a*, 23*b*, 23*c*, and 23*d*
24—Diaphragm/voice-coil assembly
25—Phasing plug input area
26—Acoustical transformer, commonly known as a "phasing plug"
26*a*—Rear phasing plug of the dual compression driver
26*b*—Front phasing plug of the dual compression driver
27—Diaphragm/voice-coil/phasing plug assembly
28—Horn throat element
28*a*—Nested horn alternative of the horn throat element
29—Horn throat area
30—Low frequency voice-coil
32—Low frequency voice-coil former
34—Low frequency membrane suspension member
36—Low frequency membrane
38—Low frequency membrane surround, referred to as outer suspension
40—Loudspeaker chassis
42—Low frequency voice-coil/membrane/suspension assembly.

DESCRIPTION OF THE FIRST EMBODIMENT

Figure 1:
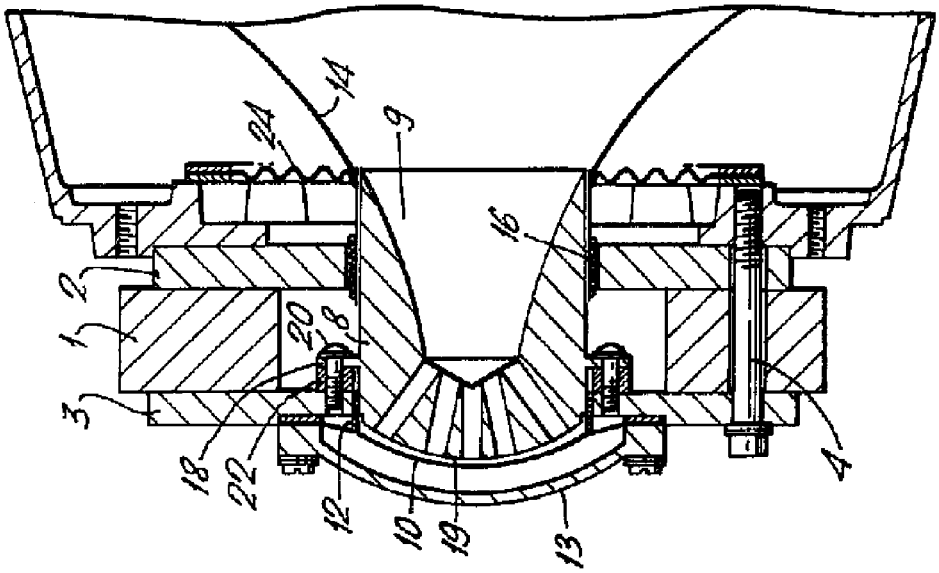
FIG. 1 PRIOR ART
FIG. 1 is a prior art illustration of a LOUDSPEAKER HAVING IMPROVED MAGNETIC ASSEMBLY [U.S. Pat. Des. 4,256,930/Mar. 17, 1981]
Figure 2A:
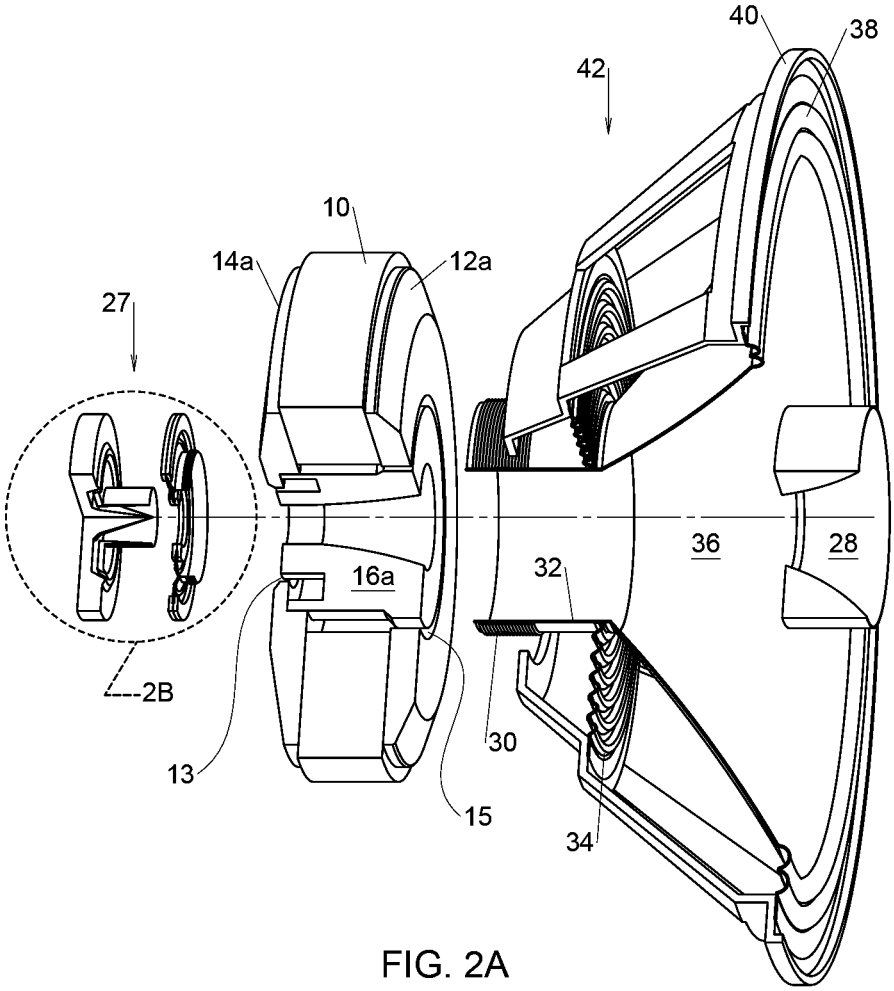
FIG. 2A is the perspective partially cross-sectional exploded schematic view of a single magnet coaxial loudspeaker with two inner voice-coil gaps.
Figure 2B:
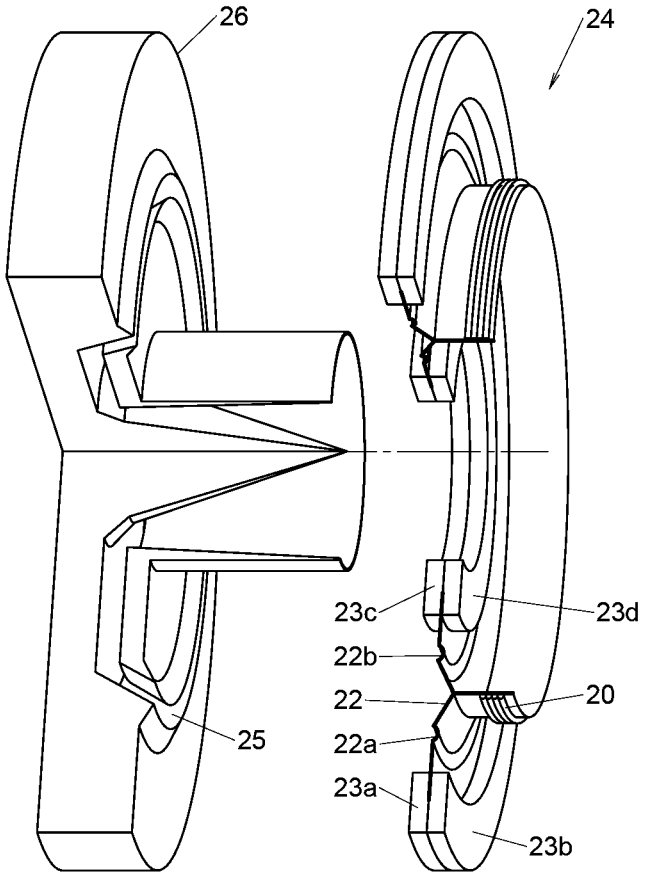
FIG. 2B is a view in detail of the portion indicated by 2B in FIG. 2A, being further referred to as a diaphragm/voice-coil/phasing plug assembly.
Figure 3A:
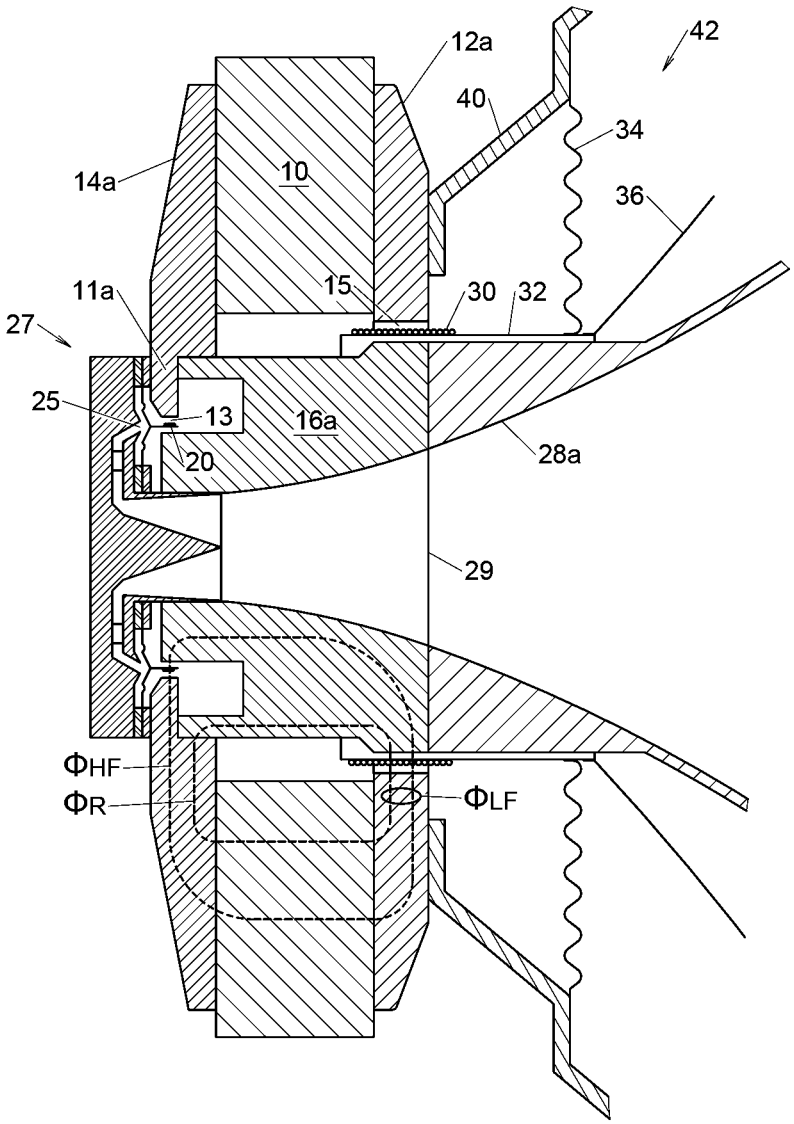
FIG. 3A is the partially cross-sectional schematic view of a single magnet coaxial loudspeaker from FIG. 2A, having a nested horn 28*a* instead of horn throat element 28.

The embodiment is illustrated in FIG. 2A, FIG. 2B and FIG. 3A and comprises an outer annular permanent magnet magnetic structure, high frequency diaphragm/voice-coil/phasing plug assembly 27 attached to the rear of the magnetic structure, low frequency voice-coil/membrane/suspension assembly 42 in front of the magnetic structure and horn throat element 28 properly attached to the magnetic structure and made of non-magnetic or of magnetic material. As an alternative, this horn throat element 28 might be replaced by nested horn 28*a* in front of the loudspeaker cone, illustrated in FIG. 3A, which cone is no longer used as a horn extension. The magnetic structure consists of permanent magnet 10, top pole piece 12*a*, bottom pole piece 14*a* and internal yoke 16*a* permanently fixed to part of bottom pole piece 14*a* in such a way as to define, together with the bottom pole piece 14*a*, one side of common region 11*a* whose flux lines are parallel in respect to high frequency voice-coil gap 13 having a smaller diameter coaxially oriented in respect to the first gap. The upper periphery of internal yoke 16*a* defines one side of larger diameter gap 15 for the low frequency voice-coil, the other side being defined by the internal diameter of top pole piece 12*a*. In this way, the magnetic structure forms two opposite internal voice-coil gaps, the front one 15 being of larger diameter, accommodating low frequency voice-coil 30, while rear smaller diameter gap 13 accommodates high frequency compression driver voice-coil 20.

Diaphragm/voice-coil/phasing plug assembly 27 in FIG. 2A, enlarged in FIG. 2B, consists of phasing plug 26 and of diaphragm/voice-coil assembly 24, comprising annular speaker high frequency diaphragm 22, which is resiliently mounted between support rings 23, comprised of parts 23*a*, 23*b*, 23*c*, and 23*d*, by means of flexible annular suspension members 22*a* and 22*b*. Voice-coil 20 is wound on the coil support portion of the diaphragm structure and is located in the magnetic gap formed between pole piece elements 14*a* and 16*a* FIG. 3A.

Low frequency voice-coil/membrane/suspension assembly 42, properly secured in front of the magnetic structure, comprises low frequency voice-coil 30 wound on its former 32, substantially centered into its gap, which former is glued to the cone membrane's 36 neck and to the inner periphery of suspension member 34, whose outer periphery is glued to chassis 40. To the top of the same chassis the outer periphery of low frequency membrane surround 38 is glued, whose inner periphery is properly connected to the cone membrane.

Operation of the First Embodiment

The magnetomotive force of permanent magnet 10 creates flux lines which are concentrated by top pole piece 12*a* as $\phi_{LF}$ through the low frequency voice-coil gap and after passing through the inner yoke, are divided into two: $\phi_{HF}$—crosses the high frequency gap and $\phi_R$—crosses common region 11*a*, before returning back through bottom pole piece 14*a* to the opposite pole of the permanent magnet. By increasing the thickness or by reducing the length of common region 11*a* geometry, the common region flux $\phi_R$ could be increased until the proportion between the low frequency voice-coil gap flux lines $\phi_{LF}$ and the high frequency voice-coil gap flux lines $\phi_{HF}$ reaches a ratio of about 3 times or higher, i.e. substantial flux is directly headed towards the low frequency voice-coil gap and only about one third or less of the low frequency flux is available for the high frequency gap alone.

High frequency diaphragm voice-coil 20 is centered into its gap 13 and by applying a signal current to the voice-coil, sound pressure waves are formed into the space between the diaphragm and the phasing plug, commonly referred to as a compression chamber, whose waves are acoustically transformed to sound pressure waves in phasing plug input area 25 by compression ratio Sd/St, i.e. diaphragm 22 area to phasing plug input area 25. These transformed waves are further propagating to the horn throat through a predetermined phasing plug expansion rate and through an opening into the magnetic structure central axis, having substantially the same expansion rate.

Figure 4A:
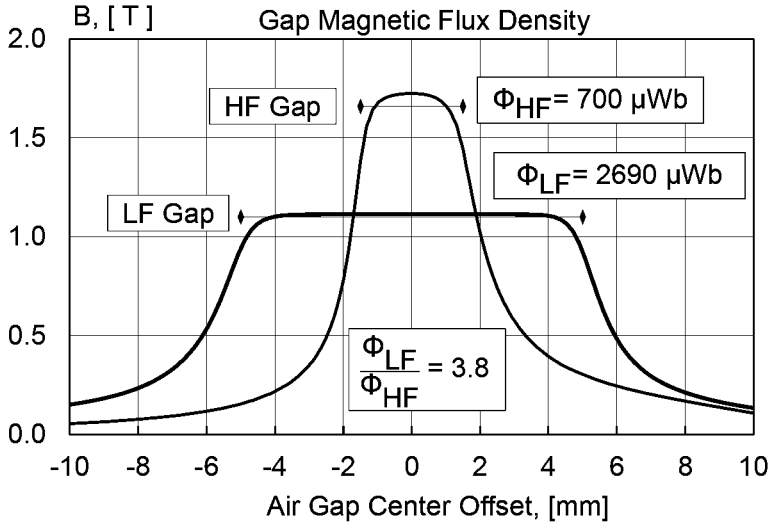
FIG. 4A illustrates the measured magnetic flux densities in the two gaps from FIG. 3A.

The measured gap flux densities of a reduced to practice sample of this embodiment are presented in FIG. 4A. Gap fluxes of 2690 micro Webbers and 700 micro Webbers were measured for the low frequency gap and for the high frequency gap respectively, making the ratio of 3.8 between them. These fluxes correspond to flux densities of 1.1 T for the low frequency gap and just under 1.7 T for the high frequency gap. The measured sample uses 3 inch low frequency voice-coil and 1.75 inch high frequency voice-coil.

Description of the Second Embodiment

Figure 3B:
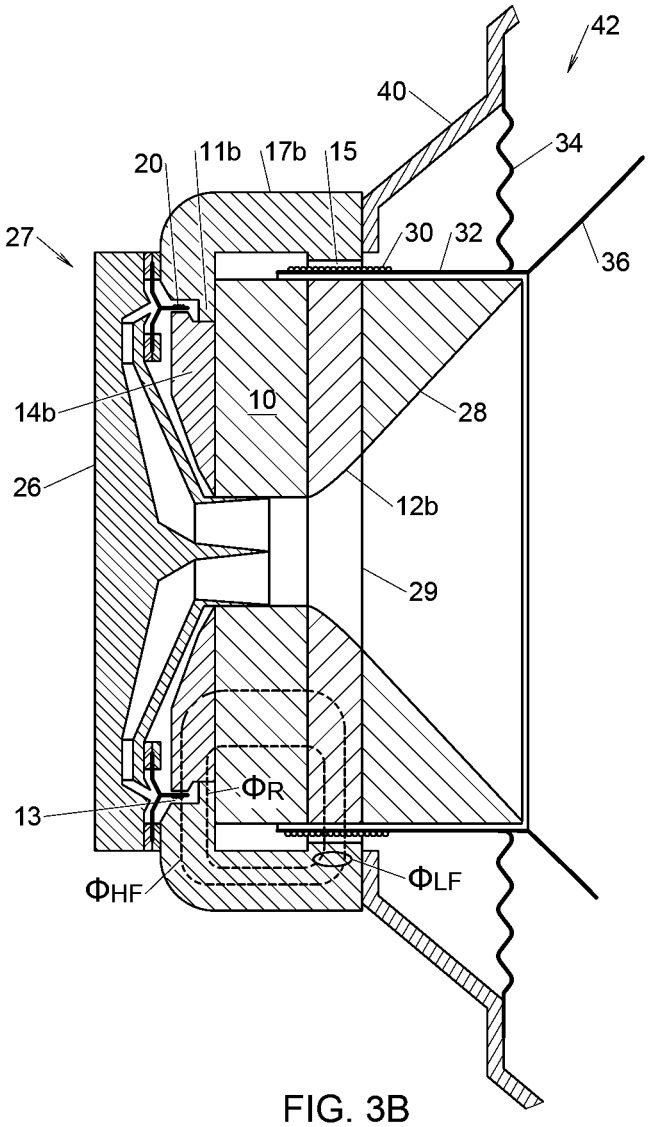
FIG. 3B is the partially cross-sectional schematic view of a single magnet coaxial loudspeaker with two outer gaps for the low frequency voice-coil and for the high frequency compression driver voice-coil.

The second embodiment, being presented with a cross-sectional view in FIG. 3B, uses substantially identical high frequency/voice-coil/phasing plug assembly 27, low frequency voice-coil/membrane/suspension assembly 42, and horn throat input part 28, which are used in the previous embodiment. The magnetic structure utilizes permanent magnet 10 better made of Nd in this embodiment, which magnet is used as inner magnet in respect to the two voice-coil gaps 13 and 15, accommodating high frequency voice-coil 20 and low frequency voice-coil 30, respectively. Both gap diameters are close to the outer annular permanent magnet diameter, the frontally positioned low frequency voice-coil gap 15 being formed between the outer periphery of top pole piece 12*b* and the upper internal diameter of outer yoke 17*b*. The lower part of this outer yoke 17*b* is permanently attached to part of the bottom pole piece in such a way as to form common region 11*b* and parallel to this region—high frequency voice-coil gap 13 is configured.

Operation of the Second Embodiment

The magnetomotive force of the permanent magnet creates flux lines $\phi_{LF}$ through the low frequency voice-coil gap and through the outer yoke these flux lines are divided into two: $\phi_{HF}$—crossing the high frequency gap and $\phi_R$—crossing common region 11*b*, before returning back through bottom pole piece 14*b* to the opposite pole of permanent magnet 10. Obviously, when the high frequency gap diameter is smaller than the magnet's outer diameter, as the current embodiment is illustrated in FIG. 3B, some parts of the flux lines will return back to the opposite pole of the magnet without crossing common region 11*b*. By increasing the thickness or by reducing the length of common region 11*b* geometry and its place, the common region flux $\phi_R$ could be increased until the proportion between the low frequency voice-coil gap flux lines $\phi_{LF}$ and the high frequency voice-coil gap flux lines $\phi_{HF}$ reaches a ratio of about 3 times or higher.

Figure 4B:
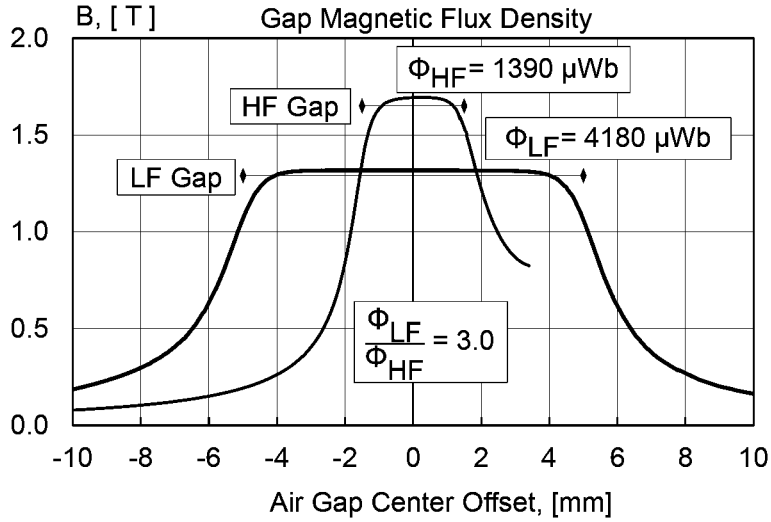
FIG. 4B illustrates the measured magnetic flux densities in the two gaps from FIG. 3B.

The measured gap flux densities of a reduced to practice sample of this embodiment are presented in FIG. 4B. Gap fluxes of 4180 micro Webbers and 1390 micro Webbers were measured for the low frequency gap and for the high frequency gap respectively, making a ratio of 3.0 between them. These fluxes correspond to flux densities of about 1.3 T for the low frequency gap and just under 1.7 T for the high frequency gap. The measured sample uses 4 inch low frequency voice-coil and 3.5 inch high frequency voice-coil.

Description and Operation of the Third Embodiment

Figure 3C:
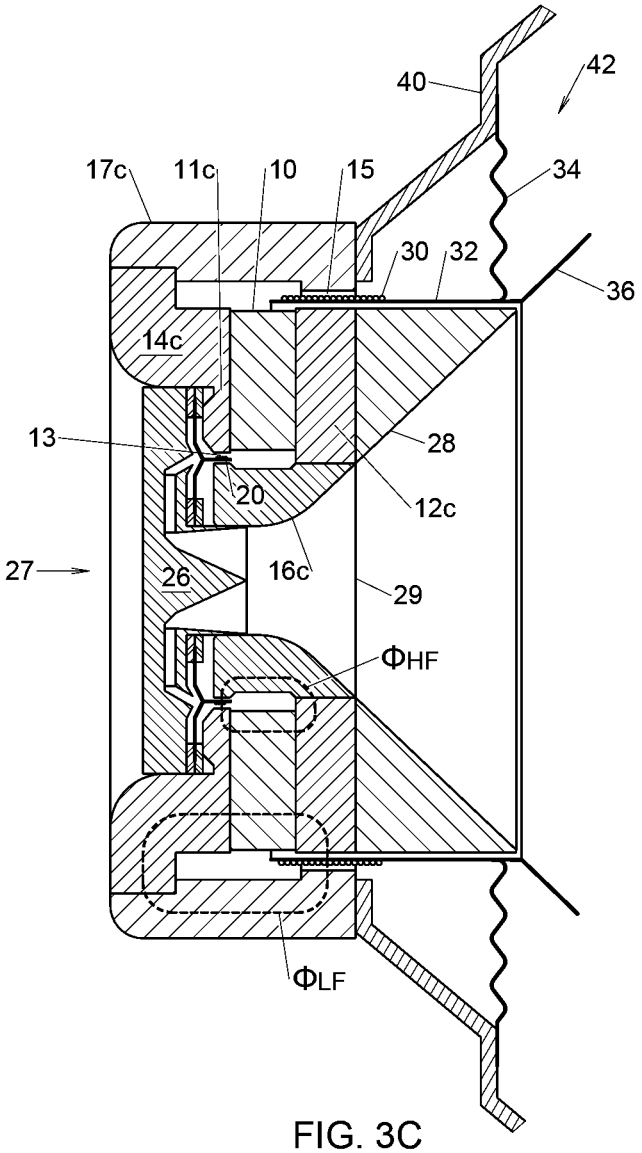
FIG. 3C is the partially cross-sectional schematic view of a single magnet coaxial loudspeaker with outer gap for the low frequency voice-coil and inner gap for the high frequency compression driver voice-coil.

The third embodiment, being presented with a cross-sectional view in FIG. 3C, uses substantially identical high frequency/voice-coil/phasing plug assembly 27, low frequency voice-coil/membrane/suspension assembly 42, and horn throat input part 28, or 28*a* as a nested horn alternative, which are used in the previous embodiments. The magnetic structure utilizes permanent magnet 10 better made of Nd in this embodiment, which magnet is used as an inner magnet in respect to larger diameter gap 15, accommodating low frequency voice-coil 30 on its former 32, but said permanent magnet 10 appears to be an outer one in respect to the smaller diameter gap 13, accommodating high frequency voice-coil 20. The frontally positioned low frequency voice-coil gap 15 is formed between the outer periphery of top pole piece 12*c* and the upper internal diameter of outer yoke 17*c*, whose lower part is permanently connected to the outer diameter of bottom pole piece 14*c*. Rear positioned high frequency voice-coil gap 13 is formed between the inner diameter of bottom pole piece 14*c* and the bottom outer diameter of internal yoke 16*c* whose top outer part is permanently connected to top pole piece 12*c* at properly established internal yoke fixing area, or internal yoke 16*c* is an integral part of top pole piece 12*c*. Both gap diameters are close to the respective annular permanent magnet diameters—internal or external. The central part of bottom pole piece 14*c* has common transition region 11*c* around which the thicknesses of the adjacent to that common transition region soft iron profile has been changed substantially. This bottom pole piece transition region 11*c* is conveniently used to accommodate diaphragm/voice-coil/phasing plug assembly 27 of the high frequency compression driver part of the co-axial loudspeaker. By changing the geometry and the position of this common transition region, i.e. the outer diameter of the diaphragm/voice-coil/phasing plug assembly, and/or by changing the thickness proportion on both sides of this common transition region 11*c*, the total magnet flux could be properly divided between the low frequency flux $\phi_{LF}$ and the high frequency flux $\phi_{HF}$ through respective gaps in such a way as to reach the sought after in this invention proportion between them, of around 3 times or higher. Reducing this common transition region by cutting the bottom pole piece recess just under the diaphragm/voice-coil/phasing plug outer periphery would reduce the cross modulation between the two magnetic paths. This interference could actually be eliminated by cutting the recess to the permanent magnet face, eliminating in fact the common transition region.

As with the previous embodiments, even though an annular diaphragm type compression driver is illustrated, it is clear that a dome type diaphragm/voice-coil/phasing plug assembly might be used instead, probably with minor nearby internal yoke edge modifications.

Figure 4C:
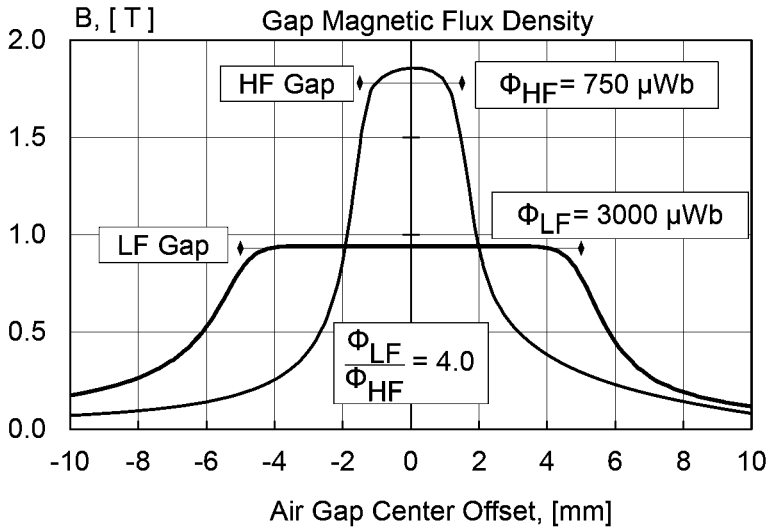
FIG. 4C illustrates the measured magnetic flux densities in the two gaps from FIG. 3C.

The measured gap flux densities of a reduced to practice sample of this embodiment are presented in FIG. 4C. Quite symmetrical gap fluxes of 3000 micro Webbers and 750 micro Webbers were measured for the low frequency gap and for the high frequency gap respectively, making a ratio of 4.0 between them. These fluxes correspond to flux densities of just under 1 T for the low frequency gap and about 1.8 T for the high frequency gap. The measured sample uses 4 inch low frequency voice-coil and 1.75 inch high frequency voice-coil.

Description and Operation of the Fourth Embodiment

Figure 3D:
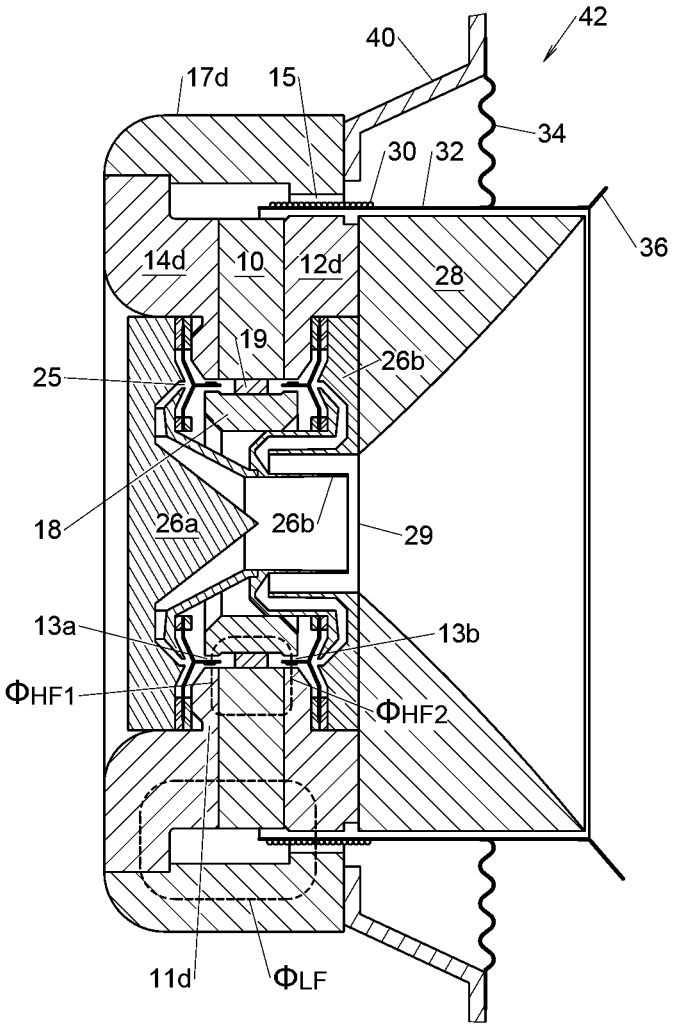
FIG. 3D is the partially cross-sectional schematic view of a single magnet coaxial loudspeaker with an outer gap for the low frequency voice-coil and two inner gaps in series for a dual diaphragm compression driver having two diaphragm/voice-coil assemblies working through two different phasing plugs, forming actually a differential phasing plug having a common output at the horn throat.

The fourth embodiment, presented with a cross-sectional view in FIG. 3D, uses substantially identical low frequency voice-coil/membrane/suspension assembly 42 and horn throat input part 28, or 28*a* as a nested horn alternative, which are used in previous embodiments. The magnetic structure utilizes permanent magnet 10 better made of Nd in this embodiment, which magnet is used as an inner magnet in respect to low frequency voice-coil gap 15, accommodating low frequency voice-coil 30 on its former 32, which former is glued to cone membrane 36 and to the inner periphery of the suspension 36 whose other periphery is glued on chassis 40. Permanent magnet 10 however, appears to be an outer in respect to the two high frequency voice-coil gaps 13*a* and 13*b*. Frontally positioned high frequency voice-coil gap 13*b* is formed from the magnetic structure of the previous embodiment in FIG. 3C by cutting the junction between top pole piece 12*c* and inner yoke 16*c*, thus actually transforming inner yoke 16*c* into dual gap core 18 in FIG. 3D and by forming a recess in top pole piece 12*d* to accommodate frontally positioned phasing plug 26*b* together with its preassembled diaphragm/voice-coil assembly. The low frequency voice-coil gap is formed just like in the previous embodiment, between the outer periphery of top pole piece 12*d* and the upper internal diameter of outer yoke 17*d*, whose lower part is permanently connected to the outer diameter of bottom pole piece 14*d*. Rear positioned high frequency voice-coil gap 13*a* is formed between the inner diameter of bottom pole piece 14*d* and the bottom outer diameter of the dual gap core. The upper outer part of this dual gap core 18 forms second high frequency gap 13*b* with the top pole piece 12*d* internal diameter. This top high frequency gap 13*b* is opposite the first rear gap 13*a* and having substantially the same diameter and geometry. By cutting the second high frequency gap 13*b*, the internal yoke from the previous embodiment is now turned into dual gap core 18, which needs to be mechanically secured either to the permanent magnet or to the magnetic structure by using dual gap core mounting flange 19 of non-magnetic material—FIG. 3D. Bottom pole piece 14*d* has common transition region 11*d*, around which the thicknesses of the adjacent to that common region soft iron profile, has been changed substantially. Bottom pole piece transition region 11*d* is conveniently used to accommodate bottom diaphragm/voice-coil/phasing plug assembly 24/26*a*. A substantially identical transition region is formed into top pole piece

12*d* to accommodate the second, top positioned diaphragm/voice-coil/phasing plug assembly 24/26*b*. By changing the geometry and position of common transition region 11*d*, i.e. the outer diameter of the diaphragm/voice-coil/phasing plug assembly, and/or by changing the thickness proportion on both sides of this common transition region 11*d*, the total magnet flux could be properly divided between the low frequency flux $\phi_{LF}$ and serially connected high frequency fluxes $\phi_{HF1}$ and $\phi_{HF2}$ through respective gaps in such a way as to reach the sought after in this invention proportion between them of around 3 times or higher.

Front phasing plug 26*b* is preassembled with the second diaphragm/voice-coil assembly, and is properly attached to rear phasing plug 26*a* in such a way as to actually form together a differential phasing plug, having substantially equal individual sound wave propagation paths from the respective diaphragms to common horn throat area 29, which area is sheared substantially in halves by the two phasing plug outputs.

As with the previous embodiments, even though an annular diaphragm type compression driver is illustrated, it is clear that dome type diaphragm/voice-coil/phasing plug assembly might be used instead of 24/26*a*, probably with minor nearby internal yoke edge modifications.

Figure 4D:
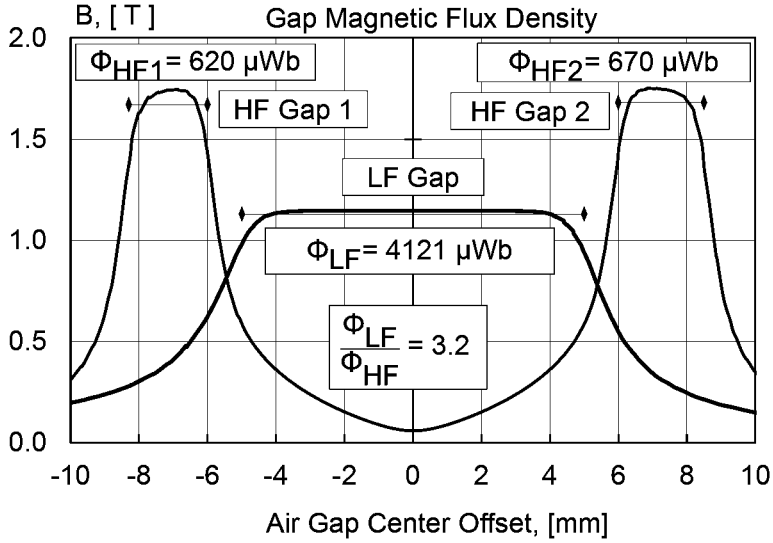
FIG. 4D illustrates the measured magnetic flux densities in the gaps from FIG. 3D.

The measured gap flux densities of a reduced to practice sample of this embodiment are presented in FIG. 4D. Quite symmetrical high frequency voice-coil gap fluxes of 620 micro Webbers and 670 micro Webbers were measured, while the low frequency gap flux was 4120 micro Webbers. These fluxes correspond to flux densities of 1.7 T for both high frequency gaps and 1.15 T for the low frequency gap. The ratio of low frequency to high frequency gaps fluxes is shown to be 3.2. The measured sample uses 4.5 inch low frequency voice-coil and 2 inch high frequency voice-coil.

Description and Operation of the Fifth Embodiment

The fifth embodiment uses a substantially identical physical structure as the forth embodiment illustrated in FIG. 4D, whereby the voice-coils of the two diaphragm/voice-coil/phasing plug assemblies 24/26*a* and 24/26*b* are not connected in parallel or in series, and are not driven by the same signal, but are rather used at different frequency bands; i.e. 24/26*a* might be used at mid frequency while 24/26*b* at high frequency, or vice versa. It is obvious that one of the assemblies might be optimized for lower frequency band operation in respect to the other, by having larger diaphragm area, larger diaphragm to phasing plug distance and/or lower suspension members 22*a*, 22*b* stiffness. Practical frequency bands of the two compression driver diaphragm/voice-coil assemblies would be 600 Hz to 6 kHz for the mid frequency one and 6 kHz to 20 kHz for the high frequency one, although they might differ from these figure ranges substantially. This embodiment is actually a three-axial, three band loudspeaker realization of the coaxial loudspeaker, resulting in greatly reduced intermodulation distortion products generation in comparison with those generated by the wider band single diaphragm compression driver and probably in comparison even with the dual membrane single band compression driver co-axial loudspeaker, described in the previous embodiment section.

This embodiment could conveniently utilize a dome diaphragm type compression driver in place of 24/26*a*, whereas 24/26*b* is limited for this and for the previous embodiment to an annular diaphragm type compression driver, in order to ensure a central axial opening for the opposite diaphragm sound radiation.

What is claimed is:

1. Single magnet coaxial loudspeaker, comprising:

a. A single permanent magnet magnetic structure, with its top pole piece defining the one side of a larger diameter gap for a low frequency cone membrane voice-coil, and the other side of said larger diameter gap being defined by a soft magnetic material yoke of predetermined thickness, said yoke being permanently fixed to part of bottom pole piece, said part of bottom pole piece defining one side of a common region whose flux is parallel connected to the high frequency voice-coil gap flux, said high frequency voice-coil gap having a smaller diameter coaxially oriented in respect to the first gap, said common region geometry controlling the flux division to insure a substantial flux to be directly headed towards the low frequency voice-coil gap and only about one third or less of the low frequency flux to be available for the high frequency gap alone, b. A low frequency voice-coil wound on its former, said former permanently attached by proper means to the cone membrane, said voice-coil substantially centered into its gap, said membrane attached at its larger diameter periphery to the loudspeaker chassis by an outer suspension, c. A high frequency voice-coil permanently attached to the compression driver diaphragm, said voice-coil substantially centered into its gap, said diaphragm creating sound waves propagating to the horn throat through a phasing plug with predetermined input area and predetermined expansion rate to the horn throat through an opening into the magnetic structure central axis, said opening of predetermined dimensions and shape.

2. The single magnet coaxial loudspeaker of claim 1, further having both its gaps inside the inner diameter of the annular magnet, said magnet being used as an outer magnet for both voice-coils.

3. The single magnet coaxial loudspeaker of claim 1, further having both its gaps close in diameter to the outer annular magnet diameter, said magnet being used as an inner magnet for both voice-coils.

4. Single magnet coaxial loudspeaker, comprising:

a. A single permanent magnet magnetic structure, with its top pole piece defining with its outer side the one side of a larger diameter gap for a low frequency cone membrane voice-coil, the other side of said larger diameter gap being defined by a soft magnetic material external yoke of predetermined thickness, said yoke being permanently fixed to the outer bottom pole piece side or being an integral part of it, said bottom pole piece inner side defining one side of a smaller diameter gap, the other side of said smaller diameter gap being defined by a soft magnetic material internal yoke of predetermined thickness having central opening, said internal yoke permanently fixed to the top pole piece forming an internal yoke fixing area or being an integral part of it, and said smaller diameter gap being coaxially oriented in respect to the larger diameter gap, said bottom pole piece being of predetermined profile geometry with a common transition region whose position and geometry control parallel magnetic flux division proportion between the frontally positioned outer gap and the rear inner gap, insuring substantially more flux to be headed towards the low frequency voice-coil gap and only about a third or less of this outer flux to remain from the total magnet flux for the high frequency smaller diameter gap alone, b. A low frequency voice-coil permanently attached by proper means to the apex of the cone membrane, said membrane attached at its larger diameter to the loudspeaker chassis by an outer suspension, c. A high frequency voice-coil permanently attached to the compression driver diaphragm, forming together a diaphragm/voice-coil assembly, said diaphragm creating sound waves propagating to the horn throat through a phasing plug of predetermined input area and expansion rate and through a predetermined opening into the center core pole piece axis of the magnetic structure.

5. The single magnet coaxial loudspeaker of claim 4, further including:

a. A second smaller diameter gap formed at said internal yoke fixing area to the top pole piece near the top magnet inner diameter, said second smaller diameter gap having close dimensions to the first smaller diameter gap, and said second smaller diameter gap changing said internal yoke into a dual gap core, b. A dual gap core mounting flange of non-magnetic material with predetermined shape properly mechanically securing said dual gap core to the permanent magnet or to the magnetic structure, c. A second said diaphragm/voice-coil assembly with its voice-coil substantially centered into the second smaller diameter gap and positioned against the first said high frequency voice-coil in its respective gap, d. A front phasing plug, properly integrated with the second diaphragm/voice-coil assembly, which, together with said rear phasing plug, actually forming a differential phasing plug having substantially equal individual sound wave propagation paths from the respective diaphragms to the common horn throat area, said horn throat area sheared substantially by halves by the two phasing plug outputs.

6. The single magnet coaxial loudspeaker of claim 5, whereby said second diaphragm/voice-coil assembly is driven by the same frequency band in phase signal fed to the first high frequency voice-coil/diaphragm assembly, thus resulting in a dual compression driver coaxial loudspeaker realization.

7. The single magnet coaxial loudspeaker of claim 5, whereby said second diaphragm/voice-coil assembly is driven by different frequency band signal in regards to the one fed to the first high frequency voice-coil/diaphragm assembly, thus resulting in a three-axial, three band loudspeaker realization of the coaxial loudspeaker.

* * * * *